US009971311B2

(12) United States Patent
Friedli et al.

(10) Patent No.: US 9,971,311 B2
(45) Date of Patent: May 15, 2018

(54) POWER RESERVE INDICATOR FOR TIMEPIECES

(71) Applicant: ETA SA Manufacture Horlogere Suisse, Grenchen (CH)

(72) Inventors: Matthaus Friedli, Solothum (CH); Florent Strahm, Sonceboz-Sombeval (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 29 days.

(21) Appl. No.: 15/140,991

(22) Filed: Apr. 28, 2016

(65) Prior Publication Data

US 2016/0349709 A1 Dec. 1, 2016

(30) Foreign Application Priority Data

May 29, 2015 (EP) ..... 15169914

(51) Int. Cl.
*G04B 1/18* (2006.01)
*G04B 9/00* (2006.01)
(Continued)

(52) U.S. Cl.
CPC ..... *G04C 10/04* (2013.01); *G04B 1/18* (2013.01); *G04B 9/005* (2013.01); *G04B 13/008* (2013.01)

(58) Field of Classification Search
CPC ..... G04B 1/18; G04B 13/008; G04B 9/00; G04B 9/005; G04B 9/02
See application file for complete search history.

(56) References Cited

U.S. PATENT DOCUMENTS 790,509 A * 5/1905 Mazer ..... G04B 9/00 368/212
1,173,466 A * 2/1916 Teske ..... G04B 9/00 368/212

(Continued)

FOREIGN PATENT DOCUMENTS

CN 202837824 3/2013
DE 1 015 747 B 9/1957

(Continued)

OTHER PUBLICATIONS

Meyer, Friedrich, English Translation of DE 1015747, originally published Sep. 12, 1957, retrieved from Espacenet on Jul. 20, 2017, full document.*

(Continued)

*Primary Examiner* — Amy Cohen Johnson
*Assistant Examiner* — Daniel Wicklund
(74) *Attorney, Agent, or Firm* — Oblon, McClelland, Maier & Neustadt, L.L.P.

(57) ABSTRACT

A timepiece power source is provided, including a barrel containing a mainspring mounted between a drum and an arbor rotating integrally with a ratchet wheel, including a differential gear coaxial to the barrel, with a first input driven by the ratchet wheel, a second input which is the drum, and a pivoting output wheel, coaxial to the arbor, arranged to form or to drive a power reserve indicator, the differential gear including balls driving the output wheel, cooperating with an upper surface of the drum, and with a lower surface, which is opposite thereto, of a differential plate forming the first input, pivoting coaxially on the arbor and connected to the ratchet wheel by a friction means cooperating with a plate, and the ratchet wheel forms the cover of the barrel.

12 Claims, 5 Drawing Sheets

(51) Int. Cl.
*G04B 13/00* (2006.01)
*G04C 10/04* (2006.01)

(56) References Cited

U.S. PATENT DOCUMENTS

| | | | | | |
|---|---|---|---|---|---|
| 2,443,558 | A | | 6/1948 | Frennesen | |
| 2,698,066 | A | * | 12/1954 | Favret | G04B 9/00 185/44 |
| 2,774,252 | A | * | 12/1956 | Meyer | F16H 1/28 475/263 |
| 8,251,574 | B2 | * | 8/2012 | Tran | G04B 9/00 368/142 |
| 2016/0018787 | A1 | * | 1/2016 | Villar | G04B 9/00 368/220 |

FOREIGN PATENT DOCUMENTS

| | | | |
|---|---|---|---|
| EP | 1 995 649 | A2 | 11/2008 |
| EP | 1 995 649 | A3 | 11/2008 |

OTHER PUBLICATIONS

European Search Report dated Feb. 3, 2016 in EP 15169914, filed May 29, 2015 (with English Translation).

* cited by examiner

POWER RESERVE INDICATOR FOR TIMEPIECES

This application claims priority from European Patent Application No. 15169914.7 filed on May 29, 2015, the entire disclosure of which is hereby incorporated herein by reference.

FIELD OF THE INVENTION

The invention concerns a power source for timepieces, comprising a going barrel, pivoting about an arbor, containing a mainspring mounted between a drum of said barrel and said arbor, which carries and rotates integrally with a ratchet wheel driving said arbor, said power source including a differential gear of which a first input is driven indirectly by said ratchet wheel and a second input is said drum, and whose output is a pivoting output wheel, coaxial with said arbor and arranged to form or to drive a power reserve indicator, and wherein said differential gear includes balls driving the housings of said output wheel which forms a cage, and cooperating with an upper surface of said barrel and with a lower surface, which is arranged on said upper surface side of said drum, of a differential plate, said plate is arranged to pivot on said arbor, is coaxial therewith, and is connected to said ratchet wheel or to a bottom plate by a friction means, and forms said first input.

The invention also concerns a power reserve indicator mechanism for the display of the power reserve of a timepiece power source comprising a going barrel formed of a drum, provided with a toothing and a cover, which together confine a mainspring, mounted between said barrel on the one hand, and a barrel arbor on the other hand, about which said barrel pivots, said barrel arbor carrying and rotating integrally with a transmission ratchet wheel external to said barrel and opposite to said cover, or respectively to said drum.

The invention also concerns a differential sub-assembly arranged to be mounted on a timepiece arbor.

The invention also concerns a timepiece movement including at least one such power source and/or at least one such power reserve indicator mechanism.

The invention also concerns a watch or a timepiece including at least one such power source, and/or at least one such power reserve indicator mechanism.

The invention concerns the field of mechanical timepieces, especially watches, including at least one power source comprising a mainspring barrel.

The invention concerns the complication consisting of the available power reserve display.

BACKGROUND OF THE INVENTION

The power reserve indicator of a mechanical watch, powered by one or more going barrels, is a complication that is useful for the user.

It is, however, rare, since it often requires considerable modification of the basic movement, and it takes up a great deal of space, in terms of both volume and thickness. This complication is therefore often reserved for movements housed inside quite spacious cases, and it is difficult to broaden its use.

EP Patent EP1970778 in the name of MONTRES BREGUET SA describes a power reserve indicator including a planetary differential gear of quite complex design, of which a first input is connected to the barrel arbor, a second input to the barrel, and an output to a power reserve indicator. The differential gear frame is coaxial with the barrel arbor, and the second input is integral with the barrel cover. The output is a transmission wheel with an inner toothing, which is kinematically connected to the first input by planetary wheels in mesh with each other, and which are carried by the cover.

DE Patent 1015747 in the name of FELSA AG describes a similar differential gear, with a first input connected to the barrel arbor by means of a gear train, a second input connected to the barrel, and a differential output at an output wheel which includes housings for ball or roller bearings inserted between the barrel and the last wheel of the gear train.

SUMMARY OF THE INVENTION

The invention proposes to provide a power reserve display device that is easy to produce, by converting an existing mechanical movement, inexpensive and takes up a minimum amount of space.

To this end, the invention concerns a timepiece power source.

The invention also concerns a power reserve indicator mechanism.

The invention also concerns a differential gear assembly group that is removable in one piece.

The invention also concerns a timepiece movement including at least one such power source and/or at least one such power reserve indicator.

The invention also concerns a watch or a timepiece including at least one such power source and/or at least one such power reserve indicator mechanism.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
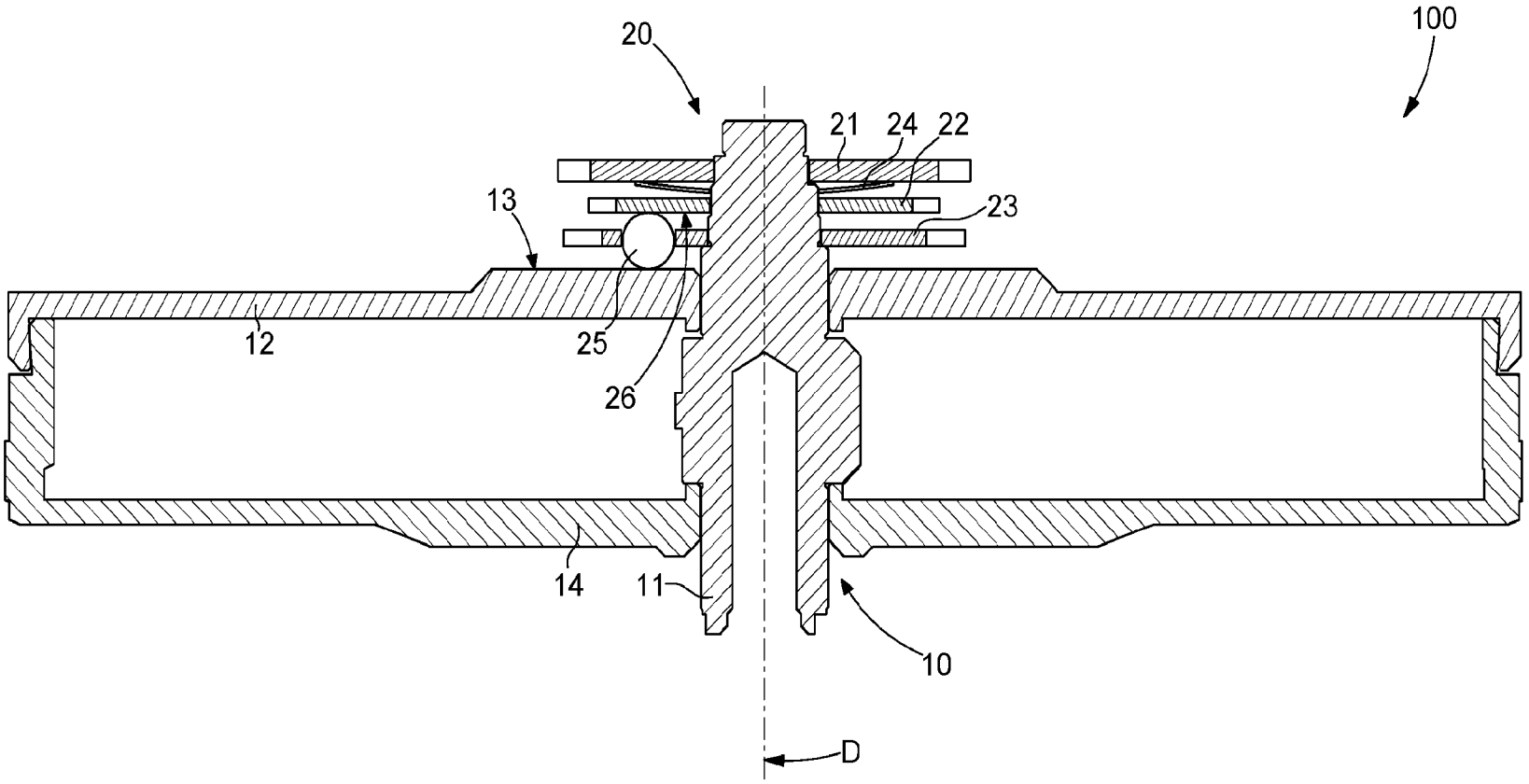
FIG. 1 shows a schematic view, in cross-section through the pivot axis, of a timepiece power source having a barrel comprising a coaxial ball differential mechanism according to the invention for displaying the remaining power reserve on an indicator controlled by an output wheel which is the wheel used as a cage for the balls of the differential mechanism.

The invention concerns a power reserve display device for a mechanical timepiece, particularly a watch, comprising at least one power source formed by a mainspring barrel.

CH Patent Application 01102/14 and EP Patent Application 14177775.5 by the same Applicant disclose a power reserve indicator for timepieces for the display of the power reserve indication of a plurality of energy accumulators, each including one indicator cooperating with one input of a differential mechanism comprised in said power reserve indicator, and wherein one output of said differential mechanism cooperates with a mechanism for the display of the total power reserve of said plurality of energy accumulators.

More specifically, in this prior art, the differential gear includes a hub driving a carrier disc, which carries balls in contact with both a first input plate and a second input plate, which are mounted for free rotation on the hub, under the action of friction imparted by one or more springs. The hub is also integral with an output in the form of a wheel, which meshes with an intermediate plate comprised in an input wheel set pivoting about a fourth pivot axis, this plate is coaxial with and pivots integrally with a pinion, which engages an input plate of a power reserve display mechanism, which is coaxial with and pivots integrally with an arbor arranged to carry a display element, such as a hand, disc or similar.

The invention described below concerns various objects with a common inventive step: a power source comprising a barrel, an additional mechanism devised for the inexpensive conversion of such a power source in order to add the power reserve display function thereto, or an independent power reserve mechanism comprising such a power source.

The invention is described only in the simple case of a power source with a single barrel, but those skilled in the art will know how to extrapolate it to a timepiece comprising several barrels, particularly with reference to the aforecited documents.

In a first variant, the invention concerns a timepiece power source 10 comprising a barrel. This barrel is of a conventional type, pivoting about an arbor 11, containing a mainspring mounted between the barrel and arbor 11, which carries an integrally rotating ratchet wheel 21 for driving the arbor.

Power source 10 includes a differential gear 20, which is coaxial with the barrel along the pivot axis D of the barrel (which is also the axis of arbor 11) and of which a first input is indirectly driven by ratchet wheel 21, and a second input is the barrel. The output of differential gear 20 is a pivoting output wheel 23, which is coaxial with arbor 11 and arranged either to form a power reserve indicator, or to drive a power reserve indicator mechanism 100, particularly, but not limited to, by means of a gear train or suchlike.

In a preferred, very economical embodiment, illustrated in the Figures, differential gear 20 includes balls 25, which cooperate with an upper surface 13 of the barrel and with a lower surface 26 of a differential plate 22. This differential plate 22 is arranged to pivot on arbor 11, is coaxial therewith, connected to ratchet wheel 21 by a friction means 24, and forms the first input. As they rotate, these balls 25 drive housings comprised in output wheel 23 which forms a cage. This lower surface 26 is arranged on the upper surface side of the barrel.

More specifically, the barrel is formed in a conventional manner of a drum 14 provided with a toothing and a cover 12 which together confine the mainspring. In the barrel assembly configuration, ratchet wheel 21 is opposite to cover 12, as seen in the Figures, or respectively to drum 14.

The first input for the winding function is driven indirectly by ratchet wheel 21 and the second input for the unwinding function is formed by cover 12, or respectively by drum 14. Balls 25 cooperate, on the one hand, with an upper surface 13 of cover 12, or respectively of drum 14, and on the other hand, with lower surface 26 of differential plate 22.

More specifically, friction means 24 is a spring disposed between ratchet wheel 21 and differential wheel 22.

In a second variant, the invention concerns a power reserve indicator mechanism 100 for displaying the power reserve of a timepiece power source 10, comprising a barrel formed of a drum 14 provided with a toothing and with a cover 12, which together confine a mainspring mounted between said barrel on the one hand and a barrel arbor 11 on the other hand, about which the barrel pivots, barrel arbor 11 carrying and pivoting integrally with a transmission ratchet wheel 21 external to the barrel and opposite to cover 12, or respectively to drum 14. This is an additional mechanism, which can simply be added to an existing barrel assembly if it is predisposed for this purpose (by suitable machining of barrel arbor 11), or added to an existing barrel assembly in which barrel arbor 11 has already been replaced with an arbor suitable for receiving power reserve indicator mechanism 100.

Mechanism 100 thus includes a very reduced number of components, each of low unit cost. Mechanism 100 includes a ball differential mechanism 20, which is coaxial to the barrel, and includes a sub-assembly which is arranged to be axially inserted between a cover 12, or respectively a drum 14, and a ratchet wheel 21. This sub-assembly includes:

a differential plate 22, which is arranged to pivot coaxially to arbor 11, said differential plate 22 being arranged between:

on an upper side, a friction drive means 24 arranged for a relative drive between differential plate 22 and a ratchet wheel 21, and, on a lower side, an output wheel 23, which is arranged to pivot coaxially to arbor 11, and which forms a cage for holding balls 25 also comprised in the sub-assembly, these balls 25 are arranged to roll between a lower surface 26 of differential plate 22 and an upper surface 13 of the cover 12, or respectively of a drum 14, and wherein output wheel 23 is arranged to form or to drive a power reserve indicator mechanism 100 of a power source 10.

Naturally, the power reserve indicator mechanism 100 can incorporate a power source 10 as described above.

The transmission of motion from ratchet wheel 21 to differential wheel 22 must respect the direction of pivoting, and may require a gear reduction ratio: due to the principle of the ball differential gear, the gear reduction ratio is 2.

Figure 2:
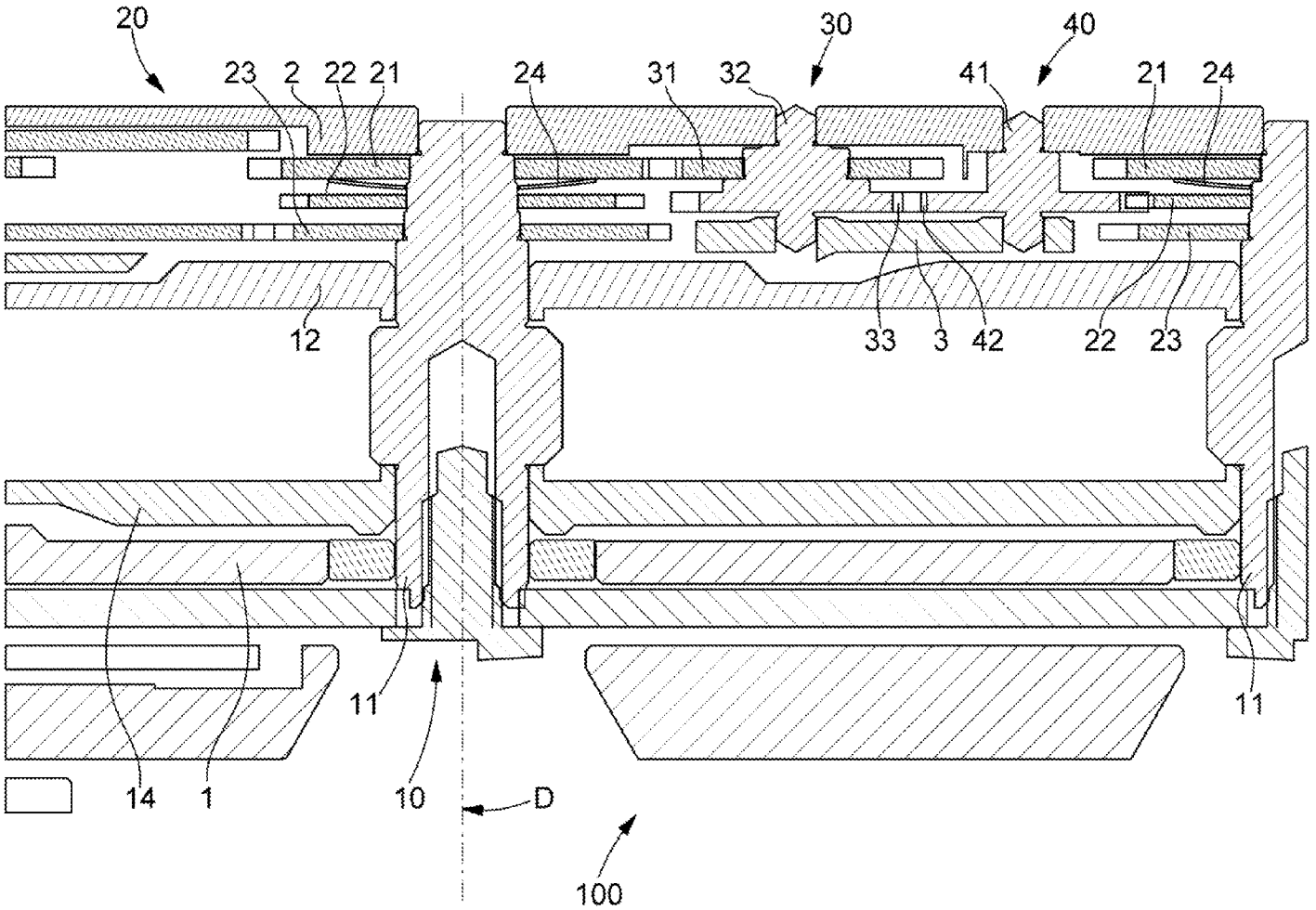
FIG. 2 shows, in a similar manner, a power reserve indicator based on the mechanism of FIG. 1, complete with winding trains for the transmission of motion between a ratchet wheel and a differential plate serving as the first input for the ball differential, the second input being formed by the actual barrel.

In a third variant, which a non-limiting example of which is shown in FIG. 2, the power reserve indicator mechanism 100 includes a bottom plate 2, which carries power source 10. Bottom plate 2 carries an intermediate train 30 for driving the differential gear, which meshes with ratchet wheel 21 and with an intermediate train 40 for the differential gear, which is also carried by bottom plate 2 and which meshes with differential plate 22.

The intermediate drive train 30 for the differential gear includes an intermediate drive pinion 32 for the differential gear, which carries an intermediate drive wheel 31 for the differential gear, which directly meshes with ratchet wheel 21. The toothing 33 of intermediate drive pinion 32 for the differential gear meshes with the toothing 42 of an intermediate differential wheel 41.

Figure 3:
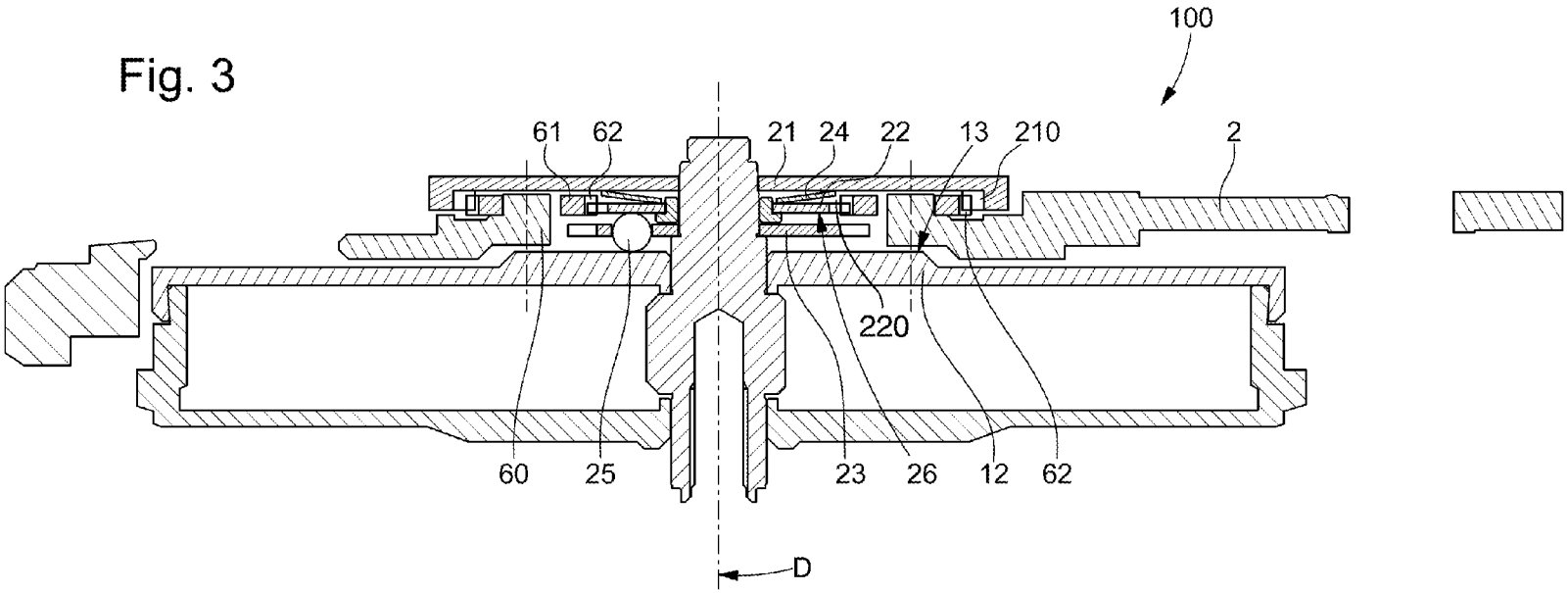
FIG. 3 shows, in a similar manner, a power reserve indicator based on the mechanism of FIG. 1, complete with a planetary winding train for the transmission of motion between a ratchet wheel and a differential plate serving as the first input for the ball differential, the second input being formed by the actual barrel.
Figure 4:
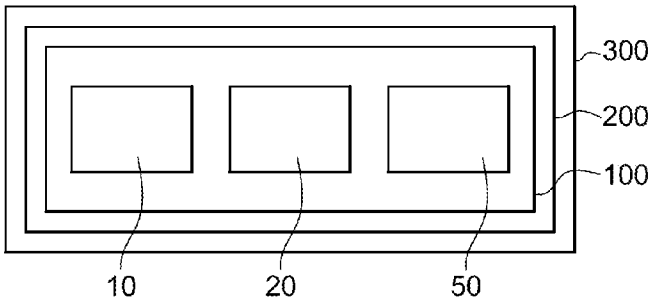
FIG. 4 is a block diagram illustrating a watch comprising a movement incorporating a power reserve indicator, a power source and a coaxial ball differential according to the invention.

In a fourth variant, shown in FIG. 3, power reserve indicator mechanism 100 includes a bottom plate 2 carrying power source 10. This bottom plate includes at least two pivots 60, each carrying a pivot 61 mounted for free rotation and having a toothing 62 which meshes, on the one hand with an external toothing comprised in differential plate 22, and on the other hand, with an internal toothing 210 comprised in a ratchet wheel 21. This fourth variant with a planetary winding train is, however, more expensive than the third variant with intermediate winding trains.

Figure 5:
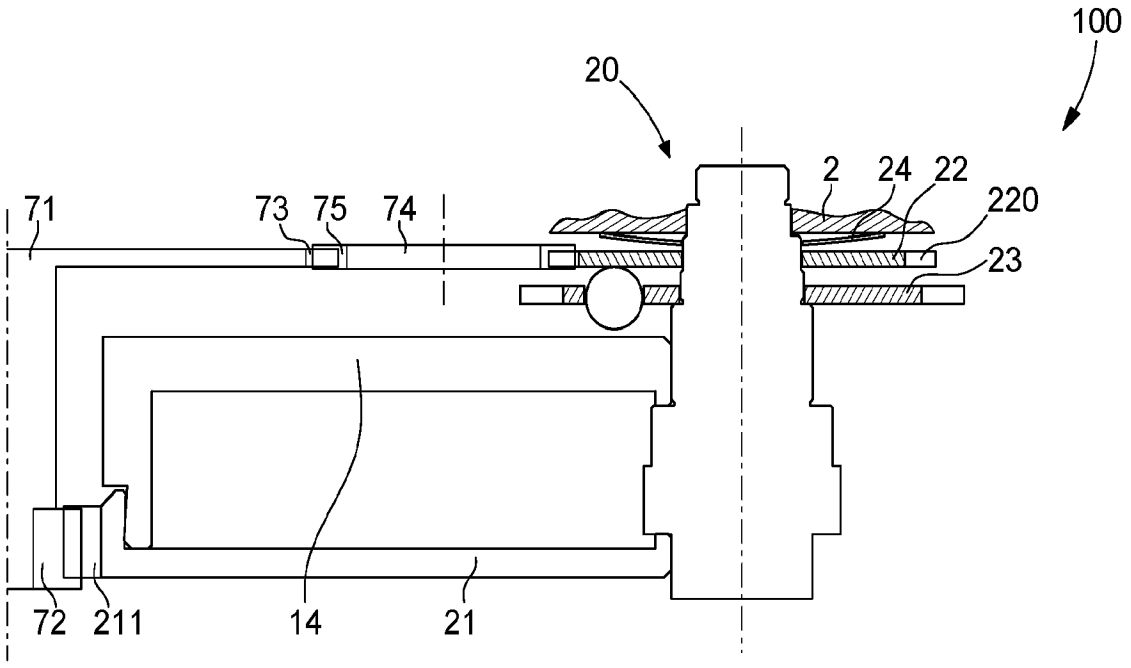
FIG. 5 shows, in a similar manner, to FIGS. 1 to 3, but more schematically, a timepiece power source having a barrel comprising a coaxial ball differential mechanism according to the invention, wherein a ratchet wheel directly forms the cover of the barrel.

FIG. 5 illustrates, in a very simplified manner, given that most of the components comprised therein are similar to those set out above, a fifth variant which advantageously has reduced axial space requirement, wherein ratchet 21 directly forms the barrel cover, and play naturally exists (not shown in the Figure) between ratchet wheel 21 and drum 14. Balls 25 cooperate here with an upper surface of drum 14. Ratchet wheel 21 includes a toothing 211 which engages with the differential plate by means of an ad hoc train. For example, in FIG. 5, toothing 211 cooperates with a first toothing 72 of an intermediate ratchet wheel 71, of which a second toothing 73 engages with a toothing 75 of an intermediate reverser 74, which also meshes with toothing 220 of differential plate 22. Friction means 24 then rests directly on a bottom plate 2. Naturally, the driving of the gear train by barrel drum 14 must then occur in another peripheral area of the barrel.

Figure 6:
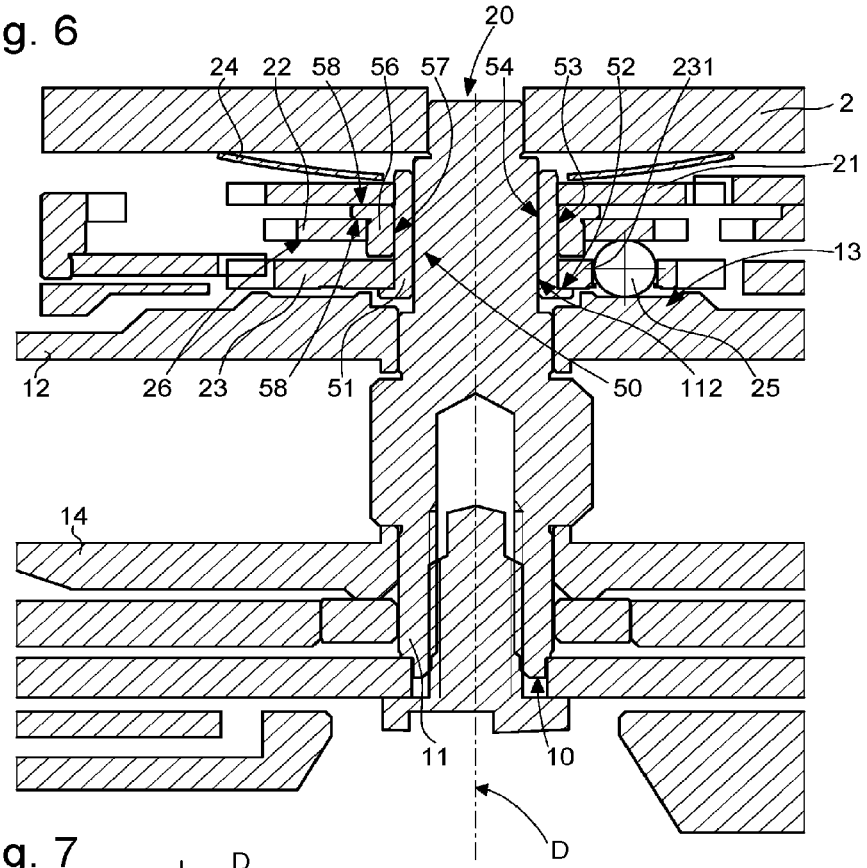
FIG. 6 shows, in a similar manner to FIGS. 1 to 3, a partial view of another variant of the power reserve indicator, comprising a differential sub-assembly removable in one piece.

FIG. 6 illustrates a sixth variant, comprising a differential sub-assembly 50 that is removable in one piece.

This differential sub-assembly 50 is completely assembled on a first stepped ring 51, arranged to be mounted for free axial rotation on a bearing surface 112 of arbor 11 onto which it is fitted. A first external shoulder 52 of the first stepped ring 51 carries output wheel 23 of the differential gear, mounted for free rotation with respect to first stepped ring 51.

As previously, output wheel 23, which forms the cage, includes inside housings 231, balls 25 which cooperate with upper surface 13 of barrel drum 14, and with the lower surface 26 of a differential plate 22. Preferably, these housings 231 are made with a necking in their lower orifice, on the side facing drum 14, to enable sub-assembly 50 to be handled without losing balls 25. This necking can be obtained when output wheel is stamped, or be achieved by a slight matting operation or a similar method. After positioning output wheel 23 equipped with its balls 25 in abutment on the first external shoulder 52, differential plate 22, which is already pressed onto a second stepped ring, is mounted in abutment on a second external shoulder 58 comprised in said second stepped ring 56. This second stepped ring 56 is mounted for free rotation on first stepped ring 51, in particular in the non-limiting embodiment of FIG. 6, a bore 57 of second stepped ring 56 pivots freely on an external bearing surface 54 comprised in first stepped ring 51.

Naturally, second stepped ring 56 and differential plate 22 can also be made as a single component, the important thing is that the toothing of ratchet wheel 21 is sufficiently separated from that of differential plate 22. The second stepped ring 56 makes it possible, in particular, to use a plate 22 produced by stamping, which is much less expensive than a machined wheel.

Differential plate 22 bears on balls 25.

Differential sub-assembly 50 is then covered by ratchet wheel 21, which is pressed onto the first stepped ring 51 and bearing on an upper bearing surface 58 of second stepped ring 56.

At this stage, the differential sub-assembly 50 can be handled as one piece, and turned over if necessary, particularly by an automated assembly means.

Figure 7:
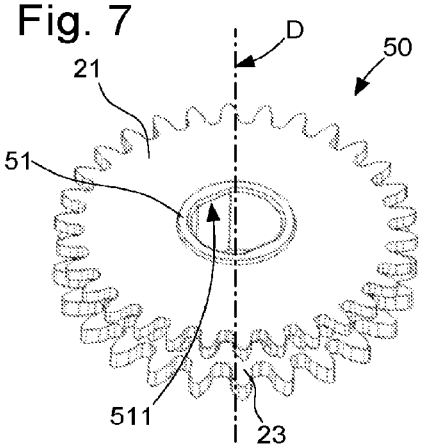
FIG. 7 shows a schematic perspective view of such a differential sub-assembly, seen from an upper side opposite to the lower side from which the balls protrude.
Figure 8:
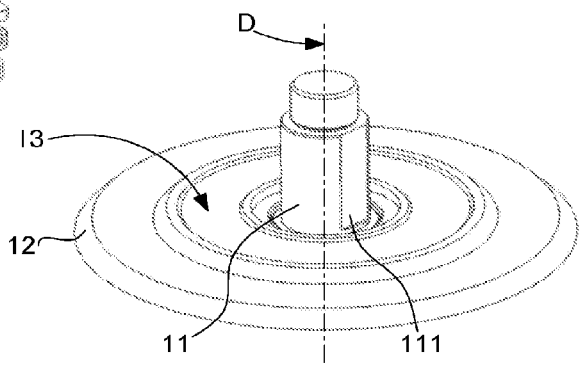
FIG. 8 shows a schematic perspective view of the upper surface of a barrel, and an arbor arranged to receive the differential sub-assembly of FIG. 7.

Arbor 11 advantageously includes drive means 111, represented in a non-limiting manner in FIG. 8 by flat portions, arranged to cooperate with complementary drive means 511 comprised in first stepped ring 51, as seen in FIG. 7, for mutual rotational driving and for the winding of power source 10. Naturally, the rotational driving can be achieved by any means known to those skilled in the art, directly or indirectly by means of a key or suchlike.

FIG. 6 also shows a friction means 24 such as an elastic washer or suchlike, between ratchet wheel 21 and bottom plate 2.

The friction pushes ratchet wheel 21 and second stepped ring 56 carrying differential plate 22, which thus still forms the first input of the differential gear, the second input being formed by the barrel drum 14.

The invention thus also concerns an independent differential sub-assembly 50, arranged to be mounted on a timepiece arbor 11, which forms a sub-assembly that is removable in one piece and includes a first stepped ring 51, arranged to be mounted for free axial rotation on a bearing surface of an arbor 11 and pivoting integrally with said arbor 11; said first stepped ring 51 carries, coaxially, an output wheel 23 mounted for free rotation with respect to first stepped ring 51, this output wheel 23 forming a cage for a plurality of balls 25 protruding at a lower end of said differential sub-assembly 50 and arranged to roll over a surface of revolution of a wheel set or of a barrel, this first stepped ring 51 carrying, directly or indirectly, a differential plate 22, also mounted for free rotation on the first stepped ring 51 and friction mounted on the balls 25 on the side opposite to their protruding end at the lower end, and a ratchet wheel 21 being pressed onto the first stepped ring 51 for the friction driving of differential plate 22.

The invention also concerns a timepiece movement 200 including at least one such power source 10 and/or at least one such power reserve indicator mechanism 100.

The invention also concerns a watch 300, or a timepiece, including at least one such power source 10, and/or at least one such power reserve indicator mechanism 100.

In short, the incorporation of a ball differential gear directly on the barrel, in a coaxial manner, according to the invention, offers a useful watch complication, at an acceptable production cost, since it requires only limited conversion operations, and the addition of a small number of simple components.

As regards the barrel, only the arbor requires modification. It is no longer necessary to add a pinion integral with the cover or with the drum to drive the differential gear.

Considerable height is saved compared to a standard different gear.

There is a significant spacing saving in the horizontal dimension because the differential gear is coaxial to the barrel.

The cover (or the drum, depending on the arrangement) of the barrel serves directly as the input for unwinding.

The output wheel 23 of the differential gear cannot be driven directly through the transmission ratchet wheel 21; indeed, because the ratchet wheel rotates in the same direction as the barrel, the differential output would only rotate in one direction. This is why, according to the invention, a gear train is incorporated to change the direction of pivoting. The transmission ratchet wheel, integral with the barrel arbor, drives the differential plate through a simple kinematic connection, in particular a gear train, with the insertion of a reverser to return to the correct direction of pivoting: this is the subject of the third and fourth variants, respectively comprising a double gear train and a planetary gear train, which is slightly more expensive but more compact than the double gear train. Whichever solution is selected, the overall space saving remains significant compared to the prior art.

What is claimed is:

1. A timepiece power source for timepieces, comprising:

a going barrel, pivoting about an arbor, containing a mainspring mounted between a drum of said barrel and said arbor, which carries and rotates integrally with a ratchet wheel for driving said arbor, and a differential gear of which a first input is driven indirectly by said ratchet wheel and a second input is said drum, and whose output is a pivoting output wheel, coaxial with said arbor and arranged to form or to drive a power reserve indicator, wherein said differential gear includes balls driving housings of said output wheel which forms a cage, and cooperating with an upper surface of said barrel and with a lower surface, which is arranged on the side of said upper surface of said drum, of a differential plate, said differential plate is arranged to pivot on said arbor, coaxially thereto, and forms said first input, and wherein said ratchet wheel is incorporated in said barrel for which said rachet wheel forms a cover, and said differential plate is connected to a bottom plate by a friction means.

2. The timepiece power source according to claim 1, wherein said ratchet wheel includes a ratchet toothing, which engages via a gear train with a plate toothing of said differential plate, said plate toothing cooperates with a first toothing of an intermediate ratchet wheel, of which a second toothing engages with an intermediate toothing of an intermediate reverser, which also meshes with said plate toothing of said differential plate.

3. A timepiece movement including at least one power source according to claim 1.

4. A watch timepiece including at least one power source according to claim 1.

5. The timepiece power source according to claim 1, wherein said friction means is a spring or an elastic washer.

6. A timepiece power source comprising:

a going barrel, pivoting about an arbor, containing a mainspring mounted between a drum of said barrel and said arbor, which carries and rotates integrally with a ratchet wheel for driving said arbor, and a differential gear of which a first input is driven indirectly by said ratchet wheel and a second input is said barrel, and whose output is a pivoting output wheel, coaxial to said arbor and arranged to form or to drive a power reserve indicator, wherein said differential gear includes balls driving housings of said output wheel which foams a cage, and cooperating with an upper surface of said barrel and with a lower surface, which is arranged on the side of said upper surface of said barrel, of a differential plate, said differential plate is arranged to pivot on said arbor, coaxially thereto, and forms said first input, wherein said differential gear is a differential sub-assembly, which is removable in one piece and includes a first stepped ring, arranged to be mounted for free axial rotation on a bearing surface of said arbor and to pivot integrally with said arbor, said first stepped ring carries said output wheel mounted for free rotation with respect to said first stepped ring, which also carries, directly or indirectly, said differential plate which also rotates freely on said first stepped ring, and wherein said differential plate bears on said balls, and said ratchet wheel is pressed, via friction means mounted between the ratchet wheel and a bottom plate, onto said first stepped ring for the friction driving of said differential plate.

7. The timepiece power source according to claim 6, wherein said friction means is a spring or an elastic washer.

8. The timepiece power source according to claim 6, wherein said ratchet wheel is external to said barrel, which includes a drum provided with a toothing and with a cover, and is opposite to said cover or respectively to said drum, and in that said differential gear is arranged to be axially inserted between said cover, or respectively said drum and said ratchet wheel.

9. The timepiece power source according to claim 6, wherein said power source includes a bottom plate which carries a first intermediate train for driving the differential gear, which meshes with said ratchet wheel and with a second intermediate train for the differential gear, which is also carried by said bottom plate and which meshes with said differential plate.

10. A timepiece power source comprising:

a going barrel, pivoting about an arbor, containing a mainspring mounted between a drum of said barrel and said arbor, which carries and rotates integrally with a ratchet wheel for driving said arbor, and a differential gear of which a first input is driven indirectly by said ratchet wheel and a second input is said barrel, and whose output is a pivoting output wheel, coaxial with said arbor and arranged to form or to drive a power reserve indicator, wherein said differential gear includes balls driving housings of said output wheel which forms a cage, and cooperating with an upper surface of said barrel and with a lower surface, which is arranged on the side of said upper surface of said drum, of a differential plate, said differential plate is arranged to pivot on said arbor, coaxially thereto, is connected to said ratchet wheel or to a bottom plate by a friction means, and forms said first input, wherein the power source includes a bottom plate which carries said power source and which includes at least two pivots each carrying a freely mounted pinion, and a toothing of each of the freely mounted pinions meshes, on the one hand, with an external toothing comprised in said differential plate, and on the other hand, with an internal toothing comprised in said ratchet wheel.

11. A differential gear group, arranged to be mounted on a timepiece arbor, comprising:

a first stepped ring, arranged to be mounted for free axial rotation on a bearing surface of an arbor and pivoting integrally with said arbor, said first stepped ring carries, coaxially, an output wheel mounted for free rotation with respect to said first stepped ring, said output wheel forming a cage for a plurality of balls protruding at a lower end of said differential sub-assembly and arranged to roll over a surface of revolution of a wheel set or of a barrel, said first stepped ring carrying, via a second stepped ring, a differential plate, said second stepped ring being mounted for free rotation on said first stepped ring, the differential plate being friction mounted on said balls on the side opposite to the end thereof protruding at said lower end, and a ratchet wheel being pressed onto said first stepped ring for the friction driving of said differential plate, wherein the group forms a sub-assembly which is removable in one piece.

12. The timepiece power source according to claim 11, wherein said second stepped ring includes a shoulder protruding between the differential plate and the ratchet wheel.

* * * * *